US006302969B2

(12) United States Patent
Moster et al.

(10) Patent No.: US 6,302,969 B2
(45) Date of Patent: Oct. 16, 2001

(54) CLEANING METHODS AND/OR ARTICLES FOR HARD SURFACES

(75) Inventors: Heather Lynn Moster, Oldenburg, IN (US); Brian Joseph Roselle, Fairfield, OH (US); David Kent Rollins; Karen Marie Kershner, both of Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/836,901

(22) Filed: Apr. 17, 2001

Related U.S. Application Data

(63) Continuation of application No. 09/423,171, filed as application No. PCT/IB98/00649 on Apr. 29, 1998.

(60) Provisional application No. 60/045,492, filed on May 2, 1997.

(51) Int. Cl.[7] ..... B08B 7/00; C23G 1/00

(52) U.S. Cl. ..... 134/40; 510/218; 510/432; 510/477; 510/478; 510/505; 510/509

(58) Field of Search ..... 134/40; 510/218, 510/477, 432, 478, 505, 509

(56) References Cited

U.S. PATENT DOCUMENTS

| | | | |
|---|---|---|---|
| 2,472,794 | 6/1949 | Cothran | 99/156 |
| 3,169,564 | 2/1965 | Harrington | 146/235 |
| 3,857,983 | 12/1974 | Roth | 426/287 |
| 3,920,856 | 11/1975 | Aepli et al. | 426/287 |
| 4,002,579 | 1/1977 | Mizutani et al. | 252/544 |
| 4,140,649 | 2/1979 | Bossert et al. | 252/105 |
| 4,177,294 | 12/1979 | Lehmann et al. | 426/271 |
| 4,244,975 | 1/1981 | Herbst et al. | 426/271 |
| 4,259,216 | 3/1981 | Miyajima et al. | 252/545 |
| 4,287,102 | 9/1981 | Miyajima et al. | 252/547 |
| 4,404,040 | 9/1983 | Wang | 134/22.14 |
| 4,414,128 | 11/1983 | Goffinet | 252/111 |
| 4,442,125 | 4/1984 | Thiele | 424/318 |
| 4,592,892 | 6/1986 | Ueno et al. | 422/28 |
| 4,808,330 | 2/1989 | Chung | 252/170 |
| 4,857,345 | 8/1989 | Sardo | 426/310 |
| 5,075,026 | 12/1991 | Loth et al. | 252/122 |
| 5,094,868 | 3/1992 | Wolfram et al. | 426/286 |
| 5,190,747 | 3/1993 | Sekiguchi et al. | 424/56 |
| 5,280,042 | 1/1994 | Lopes . | |
| 5,306,444 * | 4/1994 | Kitamura et al. | 252/546 |
| 5,320,772 | 6/1994 | Tricca | 252/160 |
| 5,342,630 | 8/1994 | Jones | 424/717 |
| 5,366,995 | 11/1994 | Savage et al. | 514/588 |
| 5,460,833 | 10/1995 | Andrews et al. | 424/606 |
| 5,498,295 | 3/1996 | Murch et al. | 134/16 |
| 5,500,048 | 3/1996 | Murch et al. | 134/6 |
| 5,500,143 | 3/1996 | Murch et al. | 252/108 |
| 5,503,764 | 4/1996 | Murch et al. | 252/90 |
| 5,549,758 | 8/1996 | Murch et al. | 134/6 |
| 5,749,924 | 5/1998 | Murch et al. | 8/137 |
| 5,849,678 | 12/1998 | Murch et al. | 510/111 |
| 5,914,302 | 6/1999 | Murch et al. | 510/293 |
| 5,932,527 | 8/1999 | Roselle et al. | 510/111 |
| 5,972,857 * | 10/1999 | Roselle et al. | 510/111 |
| 5,997,654 | 12/1999 | Murch et al. | 134/6 |

FOREIGN PATENT DOCUMENTS

| | | | |
|---|---|---|---|
| 1166547 | 6/1981 | (CA) | C11D/9/00 |
| 4023418 A1 | 2/1992 | (DE) | C11D/3/36 |
| WO 97/01288 | 1/1997 | (WO) | A23P/1/00 |
| WO 97/01623 | 1/1997 | (WO) | C11D/3/00 |
| WO 97/15202 | 5/1997 | (WO) | A23P/1/00 |

OTHER PUBLICATIONS

Code of Federal Regulations, Food and Drugs, §173.315, "Chemicals used in Washing or to Assist in the Lye Peeling of Fruits and Vegetables", Feb., 1992.

Webster's Seventh New Collegiate Dictionary, G.&C. Merriam Company 1969, p. 154.

* cited by examiner

*Primary Examiner*—Necholus Ogden
(74) *Attorney, Agent, or Firm*—Jason J. Camp

(57) ABSTRACT

Basic cleaning compositions using toxicologically-acceptable ingredients for cleaning hard surfaces are provided. Compositions safe for use on surfaces which are contacted by food intended for ingestion by humans or lower animals, even when the compositions are incompletely removed from the cleansed surface, are described. Liquid formulations comprising surfactant, such as sodium alkyl sulfate, sodium alkylbenzene sulfonate, etc., and having a pH of above 11.6 are contacted directly onto hard surfaces to remove soil and unwanted deposits. Articles for applying the compositions to hard surfaces by spraying are disclosed.

21 Claims, No Drawings

CLEANING METHODS AND/OR ARTICLES FOR HARD SURFACES

CROSS REFERENCE TO RELATED APPLICATIONS

This patent application is a continuation of U.S. application Ser. No. 09/423,171 filed Nov. 2, 1999, now abandoned which is a 371 of International Application No. PCT/IB98/00649 filed Apr. 29, 1998, which claims the benefit of U.S. Provisional Application Serial No. 60/045,492 filed May 2, 1997.

TECHNICAL FIELD

The present invention relates to compositions, methods and/or articles for removing dirt and other unwanted residues from hard surfaces, especially those surfaces which are contacted by food intended for ingestion by humans or lower animals.

BACKGROUND OF THE INVENTION

Alkaline liquid hard surface cleaning compositions are well known in the art. The alkalinity provides improved grease cleaning properties but typically is employed in conjunction with other components which require careful rinsing of the cleaned surface before this surface could be used in any direct contact with items intended for ingestion by humans or lower animals. Conventional hard surface cleaners typically include inorganic and organic compounds which would be unacceptable if transferred to foods which contact the cleansed surface. Some cleaners employ bleaching agents, abrasives, and/or solvents which could also negatively impact food items.

Another consideration on formulation of hard surface cleaners, particularly those not intended to be thoroughly rinsed off after use, is the film/streak performance after wiping and drying of the cleaner on the surface. It is well known that liquid cleaning compositions, and especially compositions prepared for cleaning glass and kitchen tile, need exceptionally good filming/streaking properties. Because good filming/streaking properties are required especially for these cleaners, the levels of surfactants and other actives must be kept low in order to achieve this benefit. Such compositions frequently rely on the use of ammonia and strong organic solvents to achieve good results.

It will be appreciated that the formulation of truly effective compositions, especially those which can be used safely by individual consumers, for washing hard surfaces presents a unique problem to the formulator, inasmuch as many art-disclosed cleaning ingredients would, presumably, not be desirable for use in direct contact with foods where they might not be fully removed.

Moreover, it would be especially desirable to provide effective, toxicologically-acceptable cleaning compositions for hard surfaces in the form of substantially low-sudsing liquid solutions which are clear or which have only minimal haziness. Liquid solutions are convenient for the user, since they can be applied directly to hard surfaces, followed by wiping. The clarity of the liquids connotes cleanliness to the user and is thus highly desirable. Low sudsing is an important attribute so that removal of the solution by wiping is achieved quickly and easily. It would also be of advantage if such compositions could be provided in the form of concentrates, which could be diluted by the consumer before use and/or applied to the surfaces as a direct spray-on.

Unfortunately, many toxicologically-acceptable cleaning ingredients do not meet the aforesaid requirements for clear, low-sudsing, dilutable liquid products. Many detersive surfactants form cloudy or even opaque suspensions in water. Of course, many surfactants are specifically designed to be high sudsing. Still others form relatively intractable phases in their concentrated form.

It has now been discovered that certain anionic and nonionic surfactants, properly formulated with other ingredients can provide liquid compositions having the desired properties described above.

BACKGROUND ART

The use and selection of cleaning ingredients for the purpose of washing fruits and vegetables is described by the United States Code of Federal Regulations, Title 21, Section 172, 173, 182, and/or 184. These regulations restrict the ingredients that may be used for direct contact with food to those described as "generally regarded as safe" (GRAS), and a few other selected ingredients. For purposes of the present invention, ingredients that are food additives permitted for direct addition to food for human consumption as defined as "food grade". These sections also provide certain limitations on the amount of material that can be used in a given context.

Among these ingredients, the experienced formulator will find only a few ingredients which can provide effective cleaning of hydrophobic residues, such as waxes, oils, or man-made chemical residues. It is recognized these types of residues are removed most readily by surface active ingredients in water, or by organic solvents largely in the absence of water. Other types of soils, especially particulate insoluble soils that do not readily disperse in water, are effectively removed by surface active materials in water, especially when aided by complex anionic salts, such as citrates (polycarboxylates), or polyphosphate salts.

Within this limited group of ingredients the range of effective cleaning compositions well suited to the task of cleaning foods such as fruits and vegetables, especially as practiced by individual consumers, have been previously described in U.S. Pat. Nos. 5,500,048, 5,500,143, 5,500,295, and 5,503,764. This prior art, however, deals primarily with problems associated with cleaning fruits and vegetables and does not take into consideration the unique characteristics, including the superior film/streak performance, of the present invention.

SUMMARY OF THE INVENTION

The present invention encompasses compositions, articles of commerce, and methods for cleaning hard surfaces, especially those surfaces which are contacted by food intended for ingestion by humans or lower animals. The compositions demonstrate superior film/streak performance.

These aqueous compositions are suitable for cleaning hard surfaces, even when the compositions are incompletely removed from said surfaces. Such a composition comprises only food grade ingredients, has a pH of greater than 11.6, preferably greater than about 12.0, more preferably greater than about 12.5, and is essentially free of $C_8$–$C_{18}$ fatty acid or salts thereof. In order to deliver superior film/streak performance, said compositions preferably comprise less than about 2.0%, by weight of the total composition, more preferably below about 1.75%, and even more preferably below about 1.0% of non-volatile components. The compositions of the present invention comprise:

(a) from about 0.001% to about 1%, by weight of the composition, preferably from about 0.005% to about 0.5%, more preferably from about 0.01% to about 0.1 %, of nonionic and/or anionic surfactant;

(b) up to about 6% by weight of the composition, preferably from about 0.01% to about 4%, more preferably from about 0.1% to about 2% of GRAS perfume;

(c) a toxicologically acceptable alkali compound;

(d) optionally, a toxicologically acceptable sequestrant/builder;

(e) optionally, a toxicologically-acceptable preservative; and (f) the balance comprising aqueous carrier selected from water and, optionally, low molecular weight, toxicologically-acceptable organic solvent.

Preferred compositions for use herein contain only materials that are GRAS, including, of course, direct food additives affirmed as GRAS, to protect against possible misuse by the consumer.

A particularly preferred embodiment of the present invention comprises a composition suitable for cleaning hard surfaces, even when the composition is incompletely removed from said surfaces, comprising only food grade ingredients; wherein said composition consists essentially of:

(a) from about 0.005% to less than 0.5%, preferably from about 0.01% to about 0.1% of nonionic or anionic surfactant, preferably anionic;

(b) from about 0.01% to about 4%, preferably from about 0.1% to about 2%, by weight the composition, of GRAS perfume;

(c) a toxicologically-acceptable alkali compound;

(d) from about 0.5% to about 8%, preferably from about 2 to about 6% of low molecular weight, toxicologically-acceptable organic solvent; and (e) the balance comprising water; said composition having a pH of greater than 11.6, preferably greater than 12.0, and even more preferably greater than 12.5. Surprisingly, this formulation provides superior cleaning performance without the traditional builders, sequestrants or other components traditionally found in hard surface cleaning compositions.

The present invention also encompasses methods of using said compositions comprising contacting hard surfaces by direct application of said compositions in an amount effective to clean said surfaces. The compositions of the present invention are particularly effective at cleaning greasy build-up, and coffee, tea and juice stains commonly found in kitchen environments.

Another preferred variation in the above methods for cleaning hard surfaces involves placing said cleaning compositions in a spray container to provide a spray of said composition to distribute the said composition, or compositions, over the surfaces while utilizing only a minimum amount of the cleaning solution and minimizing the exposure of the remaining solution to the atmosphere, where the solution is more likely to be contaminated and/or exposed to oxygen, both of which tend to cause undesirable changes in the solutions from aesthetic and/or performance considerations. In such spray processes, there is only need for a relatively small amount of material in the package, and for individual consumer use, this is desirable, since some consumers will not be able to manipulate large weights.

The present invention also encompasses articles of commerce comprising a container containing said cleaning compositions. For individual consumer usage, typically, the container will contain no more than about two gallons (about eight liters), preferably no more than about one gallon (about four liters), especially when the container is a spray container, even one that has a tube that permits the spray device to be manipulated while the bulk container remains in place. More preferably such spray containers contain about one liter, or less, of cleaning solution.

The present invention, especially the methods involving use of hand held trigger activated spray means are primarily/solely suitable for use by individual consumers so that it is essential that extra safety be built into the product. The compositions described herein are intended to be used without a rinsing step. After cleaning hard surfaces, the cleaning compositions of the present invention are designed to be wiped from the surface. Failure to rinse thoroughly after cleaning is less of a concern if all of the ingredients are GRAS. This is especially important when concentrated basic compositions are employed.

The ingredients in the above compositions are preferably selected and used in proportions which provide substantially clear compositions. "Substantially clear" includes only minimal haziness, and preferably the compositions are completely clear. The ingredients are also selected to have minimal odor, both initially and after storage. The lack of odor is especially important in compositions for use on food.

All documents cited herein are incorporated herein by reference. All percentages are by weight of the composition unless otherwise indicated. All temperature readings are understood to be done at standard temperature and pressure unless otherwise indicated.

DETAILED DESCRIPTION OF THE INVENTION

The following toxicologically-acceptable ingredients are used in the preparation of the preferred compositions herein. By "toxicologically-acceptable" is meant that any residues from the ingredients of the compositions which may remain on the hard surfaces cleansed therewith are safe for ingestion by humans and/or lower animals.

The present invention encompasses aqueous compositions suitable for cleaning hard surfaces, even when the composition is incompletely removed from said surfaces, comprising only food grade ingredients; wherein said composition comprises from about 0.001% to about 1.0% of nonionic and/or anionic surfactant; said composition having a pH of greater than 11.6, and wherein said composition is essentially free of $C_8$–$C_{18}$ fatty acid or salts thereof.

SURFACTANT

An essential ingredient in compositions of the present invention is a food grade surface active compound. Base stable anionic surfactants can be employed, as allowed by the United States Code of Federal Regulations, Title 21, Section 173.315. Preferred are salts of dodecylbenzene sulfonate. Also described in the CFR are phosphate esters of ethylene and/or ethylene/propylene oxide adducts of aliphatic alcohols, dioctyl sulfosuccinate, or 2-ethylhexyl sulfate.

The anionic surfactants are suitably water-soluble alkyl or alkylaryl compounds, the alkyl having from about 6 to about 20 carbons, including a sulfate or sulfonate substituent group. Depending upon the level of cleaning desired one can use only the anionic detergent surfactant, or, less preferably, the anionic detergent surfactant can be combined with a cosurfactant. Nonionic surfactants, e.g., ethoxylated alcohols and/or alkyl phenols, can also be used as cosurfactants or replace the anionic altogether.

The anionic detergent surfactants herein are selected from the group consisting of $C_6$–$C_{20}$ alkyl sulfates, alkyl ethoxy ether sulfates, alkyl benzene sulfonates, olefin sulfonates, and mixtures thereof. Preferably said surfactant is selected from sodium sulfates and sulfonates, in particular, sodium alkyl sulfates, sodium n-alkylbenzene sulfonates, sodium mono- and dimethyl naphthalene sulfonates. More preferably, the anionic detergent surfactant is $C_6$–$C_{20}$ alkyl sulfate, more preferably $C_8$–$C_{16}$ alkyl sulfate. In order to provide superior cleaning performance, yet retain acceptable film/streak performance, it is preferable that more than about 95%, by weight of said surfactant, of said surfactant has an alkyl chainlength of $C_{10}$ to $C_{16}$. It is even more preferable that more than about 50%, by weight of said surfactant, of said surfactant has an alkyl chainlength of $C_{12}$.

The nonionic surfactant is preferably selected from materials known well-known in the art, such as alkylene oxide (ethylene oxide or propylene oxide) adducts of $C_{10-18}$ aliphatic alcohols or acids, $C_{10-18}$ aliphatic alcohol adducts of glucose (alkyl polyglucosides). The specific nonionic surfactant selected ideally has a hydrophilic-lipophilic balance (HLB) greater than about 10, and a cloud point above about 35° C. in the composition. The United States Code of Federal Regulations (CFR) specifically describes an ethylene oxide/propylene oxide adduct of $C_{12-18}$ aliphatic alcohol of molecular weight of about 800. Such a material is available as PLURAFAC RA-20 (BASF).

It is to be appreciated that in basic compositions the alkoxylated alcohol functions mainly as a dispersant for any soap curd which may form during the cleansing operation. Further, it is recognized that the selection of non-nitrogen containing nonionics can minimize the possibility of microbial growth in the dilute surfactant compositions.

The levels of anionic and/or nonionic surfactant useful in the present invention are determined by cleaning and film/streak performance and also by the levels deemed safe as food grade. The surfactants of the present invention are present at levels of from about 0.001% to about 1%, by weight of the composition, preferably from about 0.005 to below 0.5%, and more preferably from about 0.01% to about 0.1%.

ALKALI COMPOUND

The pH of the composition is essential to the superior cleaning performance of the compositions described herein. These highly basic compositions demonstrate superior cleaning performance on tough stains typically found in kitchen environments. Unusually stubborn stains such as those left by coffee, tea, and juices are effectively cleaned by these compositions. The pH of compositions of the present invention are above 11.6, preferably above 12, and even more preferably above 12.5.

Toxicologically-acceptable alkali compounds can be used in the compositions herein to maintain product pH in the basic range. In general terms, alkali compounds are defined as substances which have a pH value of greater than 7.0 in aqueous solution. Carbonates, bicarbonates and hydroxides are convenient and preferred alkali compounds. For ease of formulatability, and improved stability, it is highly preferred that such alkali compounds be in their sodium salt form. Sodium bicarbonate is a highly desirable material to add to the compositions of this invention as a part of the buffering system since it is readily available as baking soda in food grade and is therefore relatively inexpensive, while providing a highly desirable purity to the composition. Sodium hydroxide is also a highly preferred ingredient.

Compositions formulated with a mixture of potassium and sodium cations in molar ratios of from about 1:1 to about 10:1, preferably from about 2:1 to about 8:1, more preferably from about 4:1 to about 5:1 potassium to sodium, e.g., as provided by mixtures of potassium hydroxide (hydrate) and sodium bicarbonate, have desirable rheological properties in some respects. The compositions are thick, so as to cling to the surfaces until spread, but are readily dispensed, e.g, by means of a spray device, either aerosol or finger-activated pump. The levels and identities of the ingredients are adjusted to provide products having the desired viscosities as set forth herein, e.g., more than about 5, preferably more than about 10, more preferably more than about 50 centipoise when at rest, and less than about 150, preferably less than about 100, more preferably less than about 50 centipoise under shear of $\geqq$~1000 $sec^{-1}$.

The ability of the preferred compositions containing mixtures of both sodium and potassium cations to shear thin is important to promote easy dispensing, especially when the compositions are sprayed, while maintaining the ability to be thick, cling, and delay run off after being applied to the hard surfaces.

However, the presence of a mixed cation buffer system, particularly with respect to the possible presence of cations associated with anionic surfactants , can also lead to product instability. Therefore a highly preferred embodiment of the present invention, especially when formulating with anionic surfactant systems, is one wherein the cation associated with the anionic surfactant is the same as that associated with the alkali compound. In this respect, the use of sodium sulfates and/or sodium sulfonates in conjunction with sodium hydroxide, carbonate and/or bicarbonate is highly preferred, particularly in the case where said composition is essentially free of potassium cations from other sources.

SOLVENT

The major proportion (typically, 90%–98%, by weight) of the compositions herein comprises water as the solubilizing carrier for the ingredients. The compositions also comprise an organic co-solvent. In order to be consistent with the spirit of the present invention, the organic solvent must be one regarded as acceptable for use in the food industry. As noted in the Examples hereinafter, water-ethanol can be employed and is especially preferred when formulating the basic pH compositions herein. Other compatible, water-soluble, low molecular weight solvents such as glycerol, isopropyl alcohol and propylene glycol can also be used. The solvent level should not exceed 10% in the solution used to clean surfaces, preferably is in the range of about 0.05% to about 10%, by weight of the composition, more preferably from about 0.5% to about 8%, and even more preferably from about 2% to about 6%.

PERFUME

Most hard surface cleaner products contain some perfume to provide an olfactory aesthetic benefit and to cover any "chemical" odor that the product may have. The main function of a small fraction of the highly volatile, low boiling (having low boiling points), perfume components in these perfumes is to improve the fragrance odor of the product itself, rather than impacting on the subsequent odor of the surface being cleaned. However, some of the less volatile, high boiling perfume ingredients can provide a fresh and clean impression to the surfaces, and it is sometimes desirable that these ingredients be deposited and present on the dry surface. For the purposes of the present invention the term "perfume" is taken to include those ingredients which impart an aesthetic olfactory benefit. Such ingredients can include traditional perfumes, natural extracts, essences, and flavorings. The perfumes are preferably those that are more water-soluble and/or volatile to minimize spotting and filming. All of the perfumes useful in the present invention must be "food grade" or GRAS at the levels employed in order to be consistent with the essential character of the invention. Of particular usefulness are those perfumes which impart a citrus or lime character to the composition. Some of the perfumes useful herein are described in more detail in U.S. Pat. No. 5,108,660, Michael, issued Apr. 28, 1992, at col. 8 lines 48 to 68, and col. 9 lines 1 to 68, and col. 10 lines 1 to 24, said patent, and especially said specific portion, being incorporated by reference.

SEQUESTRANT/BUILDER

Detergent builders that are efficient for hard surface cleaners and have reduced filming/streaking characteristics at the critical levels are an optional element of the present invention. Organic poly carboxylic acids, especially those that are GRAS, such as citric, tartaric, malic, etc. acids, can be used. Ethylenediaminetetraacetic acid (hereinafter EDTA) is also an effective additive for this purpose.

These additional optional detergent builders, when present, are typically at levels of from about 0.001% to about 0.5%. more preferably from about 0.002% to about 0.3%, most preferably from about 0.01% to about 0.15%. The levels of these additional builders present in the wash solution used for glass should be less than about 0.2%. Therefore, typically, dilution is highly preferred for cleaning glass, while full strength is preferred for general purpose cleaning, depending on the concentration of the product.

PRESERVATIVE

Formulating the present compositions at high pH reduces the tendency for biological growth of contaminants, such as bacteria, fungi, or molds. Standard food-grade preservatives such as ethylenediaminetetraacetic acid and/or the salts thereof, at a level of from about 0.01% to about 0.2% of ethylenediaminetetraacetic acid, or its sodium and/or potassium salts, can be used although, in general, the basic pH compositions herein do not require a preservative.

The use of commercial surfactants containing unsaturated alkyl groups can be complicated by development of off-odors and/or yellowing of the compositions in which they appear. These undesirable properties are believed to be caused by complex side reactions initiated by the reaction of oxygen with primarily the polyunsaturated components. These results can be avoided, or minimized, by avoiding contact with air, or by controlling the quality of the alkyl substituents so that the amount and type of polyunsaturates are minimized as described above, and/or by the addition of antioxidants.

It has been found, that the addition of tocopherols (e.g., Vitamin E, or tocopherol acetates) in alkaline formulations is advantageous, as they do not degrade, nor do they impart a strong color. They inhibit the development of off-odors for extended periods of time so that the need for masking scents is minimized, or eliminated. The use of butylated phenols, such as BHT and BHA is also useful, but the quantity should be limited to avoid imparting colors to the compositions. Other food grade antioxidants such as Vitamin C and sulfites, are desirable to prevent deterioration of the compositions by the action of oxygen, but care must be taken since vitamin C can suffer color degradation and sulfites can cause odor problems. Sulfites also have been the target of potential health concerns.

SPRAY MEANS

The compositions herein are preferably used by placing them in a package comprising either an aerosol container or a non-aerosol spray device "spray means." Said spray means is any of the manually activated, preferably "trigger-type," means for producing a spray of liquid droplets as is known in the art. Typical spray means are disclosed in U.S. Pat. No. : 4,082,223, Nozawa, issued Apr. 4, 1978; U.S. Pat. No. 4,161,288, McKinney, issued Jul. 17, 1979; U.S. Pat. No. 4,558,821, Tada et al., issued Dec. 17, 1985; U.S. Pat. No. 4,434,917, Saito et al., issued Mar. 6, 1984; and U.S. Pat. No. 4,819,835, Tasaki, issued Apr. 11, 1989, all of said patents being incorporated herein by reference. The spray bottle, or container can be any of the ones commonly used for containing hard surface cleaner detergent compositions. Examples of bottles are those in U.S. Design Pat. Nos.: 244,991, Weekman et al., issued Jul. 12, 1977; and 275,078, Wassergord et al., issued Aug. 14, 1984, said patents being incorporated herein by reference.

The spray means herein can also include those that incorporate a propellant gas into the liquid and those that will foam even detergent compositions having a viscosity of less than about 15 cps. The device can also be one that can be adjusted to either give a liquid spray or a foam. The spray means herein are typically those that act upon a discrete amount of the composition itself, typically by means of a piston that displaces the composition and expels the composition through a nozzle to create a spray of thin liquid. The spray means can include a foaming spray head such as those described in U.S. Pat. Nos.: 4,350,298; 4,730,775; 4,883,227; and 4,890,792 all of said patents being incorporated herein by reference. An example of an acceptable commercially available foaming spray head is model TS-800 with foaming nozzle manufactured by Calmar, Inc.

USAGE

The compositions described herein are used for cleaning inanimate, household surfaces, especially those used in food production and other food-contacting surfaces (surfaces that come in contact with food). E.g., cutting boards, counter tops, utensils, dishes, colanders, sinks, sponges, towels, dish cloths, cloth napkins (serviettes), table cloths, and other surfaces that come in contact with food. It is desirable to disinfect/sanitize before the surfaces come in contact with the food, and is desirable to redisinfect/sanitize whenever the surfaces become recontaminated. The products herein, containing all GRAS ingredients, are perfect for this purpose. On hard surfaces, of course, the compositions can be removed, after sufficient time has elapsed, by rinsing or by absorption/wiping with an appropriate object, e.g., paper towel, sponge, squeegee, etc. The compositions are particularly well suited for removal by only wiping the treated surface.

EXAMPLES

The following Examples illustrate the compositions and processes of this invention, but are not intended to be limiting thereof. The exemplified basic liquid compositions can be prepared at pH 11.6 to above 12.5 by dissolving the ingredients in water or water-ethanol using conventional mixing apparatus. Values are weight percent unless otherwise specified.

| Ingredient | Formula A | Formula B | Formula C | Formula D |
|---|---|---|---|---|
| Sodium Lauryl Sulfate | 0.06 | 0.20 | 0.06 | |
| Sodium dodecylbenzene sulfonate | | | | 0.10 |

-continued

| Ingredient | Formula A | Formula B | Formula C | Formula D |
|---|---|---|---|---|
| Ethanol | 5.0 | 5.0 | 5.0 | 4.0 |
| Lime Perfume | 1.0 | 1.0 | | 1.5 |
| Sodium Hydroxide | 0.15 | 0.15 | 0.15 | 0.125 |
| EDTA | | | | 0.10 |
| Water | 93.79 | 93.65 | 94.79 | 94.175 |

What is claimed is:

1. A method for cleaning hard surfaces comprising contacting said hard surfaces by direct application of an aqueous cleaning solution comprising:

(a) from about 0.001% to below about 0.5% of an anionic and/or nonionic surfactant;

(b) up to about 6% by weight of GRAS perfume;

(c) a toxicologically acceptable alkali compound;

(d) optionally, a toxicologically acceptable sequestrant/builder;

(e) optionally, a toxicologically-acceptable preservative; and (f) the balance comprising aqueous carrier selected from water and, optionally, low molecular weight, toxicologically-acceptable organic solvent;

said aqueous cleaning solution having a pH of greater than 11.6; wherein said aqueous cleaning solution is essentially free of $C_8$–$C_{18}$ fatty acid or salts thereof; and wherein said aqueous cleaning solution comprises only food grade ingredients.

2. The method of claim 1 wherein said aqueous cleaning solution has a pH of more than about 12.

3. The method of claim 2 wherein said aqueous carrier comprises water and from about 0.05% to about 10%, by weight of the total composition, of organic solvent selected from the group consisting of ethanol, glycerol, isopropanol, and propylene glycol.

4. The method of claim 3 wherein said surfactant is anionic.

5. The method of claim 4 wherein said surfactant is selected from the group consisting of sodium sulfates and sulfonates, and wherein said toxicologically acceptable alkali compound is selected from the group consisting of alkali compounds having sodium cations.

6. The method of claim 5 wherein said surfactant is selected from sodium alkyl sulfates, sodium n-alkylbenzene sulfonates, sodium mono- and dimethyl naphthalene sulfonates.

7. The method of claim 6 wherein more than about 95%, by weight of said surfactant, of said surfactant has an alkyl chainlength of $C_{10}$ to $C_{16}$.

8. The method of claim 7 wherein more than about 50%, by weight of said surfactant, of said surfactant has an alkyl chainlength of $C_{12}$.

9. The method of claim 8 wherein said composition has a pH of greater than 12.5.

10. The method of claim 3 wherein said toxicologically acceptable sequestrant/builder is present in said aqueous cleaning solution and is selected from the group consisting of citric acid, tartaric acid, ethylenediaminetetraacetic acid, and mixtures thereof.

11. The method of claim 3 in which said aqueous cleaning solution has a viscosity of less than about 100 centipoise under shear of greater than about 1000 $sec^{-1}$.

12. The method of claim 11 in which said aqueous cleaning solution has a viscosity of less than about 50 centipoise.

13. The method of claim 1 wherein said aqueous cleaning solution is incompletely removed from said surface.

14. The method of claim 1 wherein said surfactant comprises sodium alkyl sulfate; wherein more than about 50%, by weight of said surfactant, of said surfactant has an alkyl chainlength of $C_{12}$; wherein said alkali compound is selected from the group consisting sodium hydroxide, sodium carbonate, and sodium bicarbonate; wherein said organic solvent is selected from the group consisting of ethanol, glycerol, isopropanol, and propylene glycol.

15. The method of claim 1 wherein said aqueous cleaning solution consists essentially of:

(a) from about 0.005% to below 0.5% of an anionic and/or nonionic surfactant;

(b) from about 0.01% to about 4%, by weight the composition, of GRAS perfume;

(c) a toxicologically-acceptable alkali compound;

(d) from about 0.5% to about 8% of low molecular weight, toxicologically-acceptable organic solvent; and (e) the balance comprising water;

said aqueous cleaning solution having a pH of greater than 11.6.

16. The method of claim 15 wherein said surfactant is present at a level of from about 0.01% to about 0.1%.

17. The method of claim 16 wherein said perfume is present at a level of from about 0.1% to about 2%.

18. The method of claim 17 wherein said composition has a pH of greater than 12.

19. The method of claim 1 wherein said aqueous cleaning solution is contained in a container and said aqueous cleaning solution is applied to said surface by dispensing said aqueous cleaning solution from said container.

20. The method of claim 19 wherein said container is a spray container, suitable for use by an individual to clean hard surfaces.

21. The method of claim 20 wherein said container comprises a foaming spray head.

* * * * *